United States Patent [19]

Koppel, deceased

[11] Patent Number: 5,031,498

[45] Date of Patent: Jul. 16, 1991

[54] APPARATUS FOR STACKING AND CUTTING ROLLS OF PAPER

[75] Inventor: Simon Koppel, deceased, late of Albuquerque, N. Mex., Anne Koppel Bienn, legal representative

[73] Assignee: Anne Koppel Conway, Las Cruces, N. Mex.

[21] Appl. No.: 15,841

[22] Filed: Feb. 17, 1987

[51] Int. Cl.[5] ..... B26D 7/06

[52] U.S. Cl. ..... 83/436; 83/208; 83/367; 83/408; 83/485; 83/614; 83/650

[58] Field of Search ..... 83/367, 436, 407, 408, 83/485–488, 649, 650, 208, 209, 210, 614

[56] References Cited

U.S. PATENT DOCUMENTS

| | | | |
|---|---|---|---|
| 2,427,611 | 9/1947 | Lane | 83/485 |
| 2,527,739 | 10/1950 | Knabusch et al. | 83/436 |
| 2,735,055 | 2/1956 | Thomas | 83/367 |
| 3,795,166 | 3/1974 | Brand | 83/650 |
| 3,986,419 | 10/1976 | Cleghorn | 83/208 |
| 4,014,535 | 3/1977 | Kleid et al. | 270/19 |
| 4,207,667 | 6/1980 | D'Angelo et al. | 29/417 |
| 4,216,688 | 8/1980 | Cash | 83/208 |
| 4,218,945 | 8/1980 | Sharlow | 83/436 |
| 4,294,144 | 10/1981 | Hayes | 83/208 |
| 6,062,257 | 12/1987 | Naert | 83/110 |

FOREIGN PATENT DOCUMENTS

| | | | |
|---|---|---|---|
| 635651 | 3/1962 | Italy | 83/650 |
| 188290 | 11/1966 | U.S.S.R. | 83/650 |

*Primary Examiner*—Frank T. Yost
*Assistant Examiner*—Scott A. Smith
*Attorney, Agent, or Firm*—Deborah A. Peacock; Donovan F. Duggan

[57] ABSTRACT

An apparatus for stacking and cutting rolls of paper, in particular end rolls from the newspaper industry. The apparatus includes a rack assembly for stacking and unrolling the end rolls, and a cutting assembly including a pair of cylindrical rollers, at least one cutting device for cutting the paper into predetermined lengths, and preferably at least one cutting device for cutting the paper into predetermined widths.

4 Claims, 3 Drawing Sheets

APPARATUS FOR STACKING AND CUTTING ROLLS OF PAPER

BACKGROUND OF THE INVENTION

This invention relates to an apparatus for cutting paper. The apparatus is especially useful for cutting end rolls, a byproduct of the newspaper industry.

In the newspaper industry, large diameter rolls of paper are processed and cut in conventional paper cutting machines, such as discussed below. As long as a roll maintains a fairly large diameter, it can be sufficiently cut by these machines. However, once the rolls become narrow (towards the end of the roll) prior art machines cannot continue to process the paper. These narrow rolls are removed and generally discarded as unusable. This narrow roll byproduct is usually called an "end roll."

Several prior art patents disclose machines for cutting paper. None of these patents disclose machines for cutting end rolls. These patents are discussed below.

U.S. Pat. No. 3,986,419, entitled MATERIAL CUTTING MACHINE, to Cleghorn, discloses a machine which accepts a sheet of paper through a pair of cylindrical rollers and cuts the sheet into a predetermined length. This patent does not disclose the stacking or cutting of rolls of paper or the cutting of multiple layers of paper.

U.S. Pat. No. 4,014,535, entitled CONTINUOUS SHEET COLLATING METHOD AND APPARATUS, to Kleid et al., discloses a collating system for wrapping a single web of paper around a rotating drum, cutting the paper into a desired length, and then collating the desired number of cut sheets. This patent does not disclose the stacking or cutting of multiple layers of paper from multiple rolls.

U.S. Pat. No. 4,062,257, entitled INDEPENDENT, OFF-LINE DEVICE FOR THE CUTTING OF A ROLL OF PAPER INTO SHEETS, to Naert, discloses a device for cutting a large roll of paper into desired single sheet lengths. This patent does not disclose the stacking or cutting of multiple layers of paper from multiple rolls.

U.S. Pat. No. 4,207,667, entitled METHOD AND APPARATUS FOR AUTOMATIC SHEET CUTTING AND STACKING, to D'Angelo et al., discloses cutting single or double layers of microfoam material into desired lengths and widths. This patent does not disclose the cutting of more than two layers. Moreover, the rolls are unrolled from beneath the roll such that the tops of the rolls rotate away from the cutting apparatus.

Accordingly, it is a primary object of the present invention to provide an apparatus for stacking and cutting paper from multiple rolls.

It is a further object of the present invention to provide an apparatus which stacks and cuts paper from end rolls.

Other objects and further scope of applicability of the present invention will become apparent from the detailed description to follow, taken in conjunction with the accompanying drawing.

SUMMARY OF THE INVENTION

This invention relates to an apparatus for stacking and cutting multiple layers of rolls of paper. The invention is useful for cutting narrow rolls of paper such as end rolls.

The invention comprises an apparatus for stacking and unrolling rolls of paper to be fed into a cutting apparatus, and a continuous cutting apparatus for cutting multiple layers of paper. Preferably both apparatuses are used in conjunction with each other to stack, unroll, and cut multiple layers of paper from end rolls.

The stacking apparatus of the invention comprises a stacking frame, at least one rack, and a multiplicity of shaft and pin assemblies. Each rack comprises two parallel bars with corresponding slots for receiving the shaft and pin assemblies. The shaft and pin assemblies comprise a central shaft with pins protruding from either end which engage with the slots. A roll of paper is slid onto a shaft and pin assembly and is thus seated on the rack.

In the preferred embodiment, the stacking apparatus of the invention comprises at least two racks, one positioned above the other. The multiple racks allow more layers of paper to be cut simultaneously. Such an embodiment allows up to 50 end rolls (having a diameter of less than seven inches) to be stacked and unrolled together on a 10' frame.

During operation of the stacking and unrolling apparatus, the rolls of paper are positioned on the racks and unrolled from the tops of the rolls. The rolls of paper are overlapped to form a multiplicity of layers near the feeding portion of a cutting apparatus. If two or more racks are utilized, the layers of paper from each rack are joined together near the feeding portion of the cutting apparatus.

The continuous cutting apparatus of the invention comprises: a cutting frame; a pair of cylindrical rollers; length controlling means for advancing layers of paper to be cut to a predetermined length; braking means for stopping the advance of the paper at the predetermined length; length cutting means for cutting the paper into sheets; and starting means, such as a limit switch, to reactivate the advance of the layers of paper. The preferred cutting apparatus comprises: adjusting means for adjusting the space between the rollers to accommodate between 3 to 50 layers of paper; variable speed means for varying the speed the rollers rotate; at least one width cutting means for cutting the layers of paper into a predetermined width; and jogging means to independently rotate the rollers to initially feed the layers of paper into the rollers. The preferred longitudinal cutting means is a circular saw; and preferably the circular saw travels only once across the frame per each cut.

During operation of the cutting apparatus, the multiplicity of layers are fed into the space between the rollers, the length controlling means rotates the rollers and advances the layers of paper to a predetermined length, the braking means stops the rotation of the rollers and the advance of the layers of paper, the length cutting means cuts the layers of paper into the predetermined length, and the starting means reactivates the rotation of the rollers after the cut has been completed. If varying widths are desired, the width cutting means further cuts the sheets into widths.

DESCRIPTION OF THE PREFERRED EMBODIMENT

This invention relates to an apparatus for stacking and cutting multiple layers of paper from rolls. The invention is especially suitable for the stacking and cutting of end rolls from the newspaper industry into a usable product. End rolls, which are cut in accordance with the invention, are useful for packing paper used by the moving and storage industry. Sheets of variable lengths and widths can be cut using the apparatus of the invention.

Figure 1:
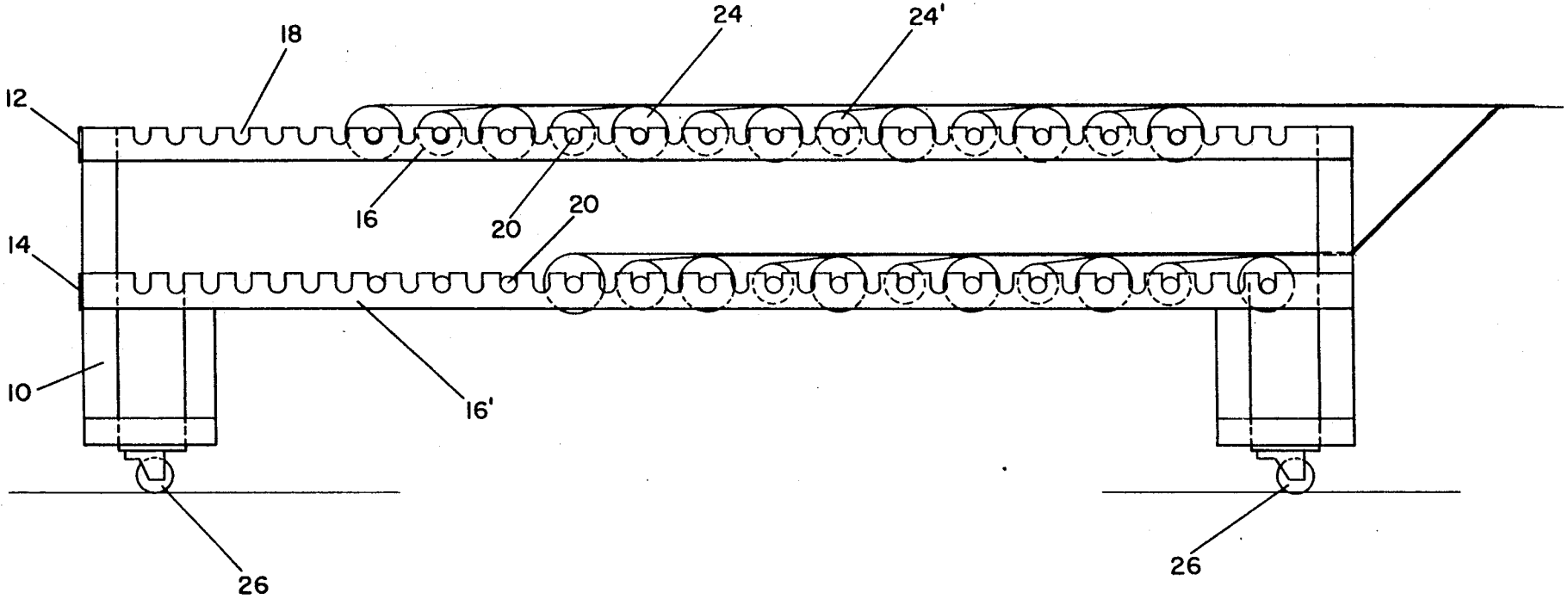
FIG. 1 is a side view of the stacking assembly of the present invention for stacking rolls of paper to be cut.
Figure 2:
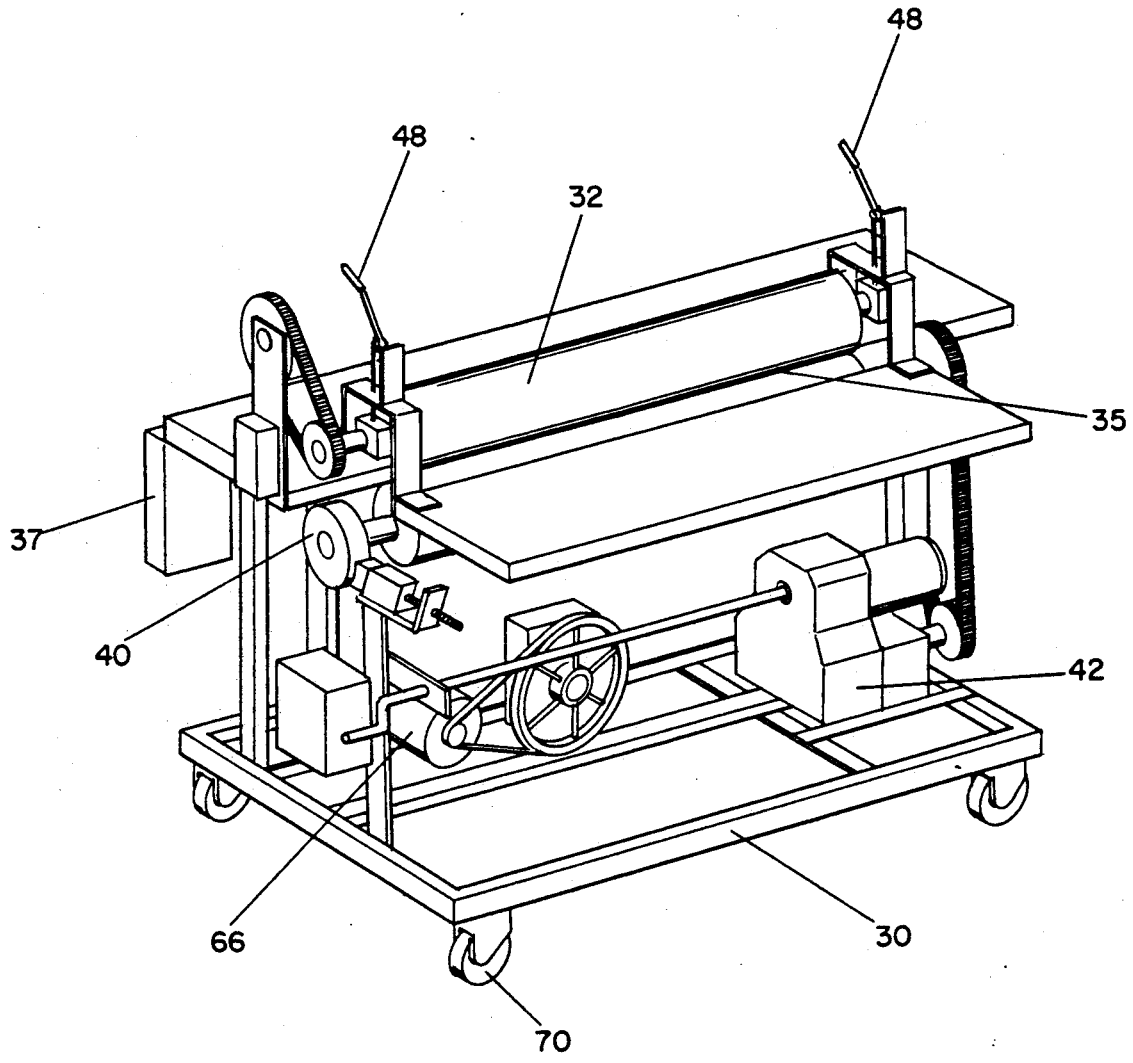
FIG. 2 is a perspective view of the front of the preferred cutting assembly of the present invention for cutting multiple layers of paper into desired lengths and widths.
Figure 3:
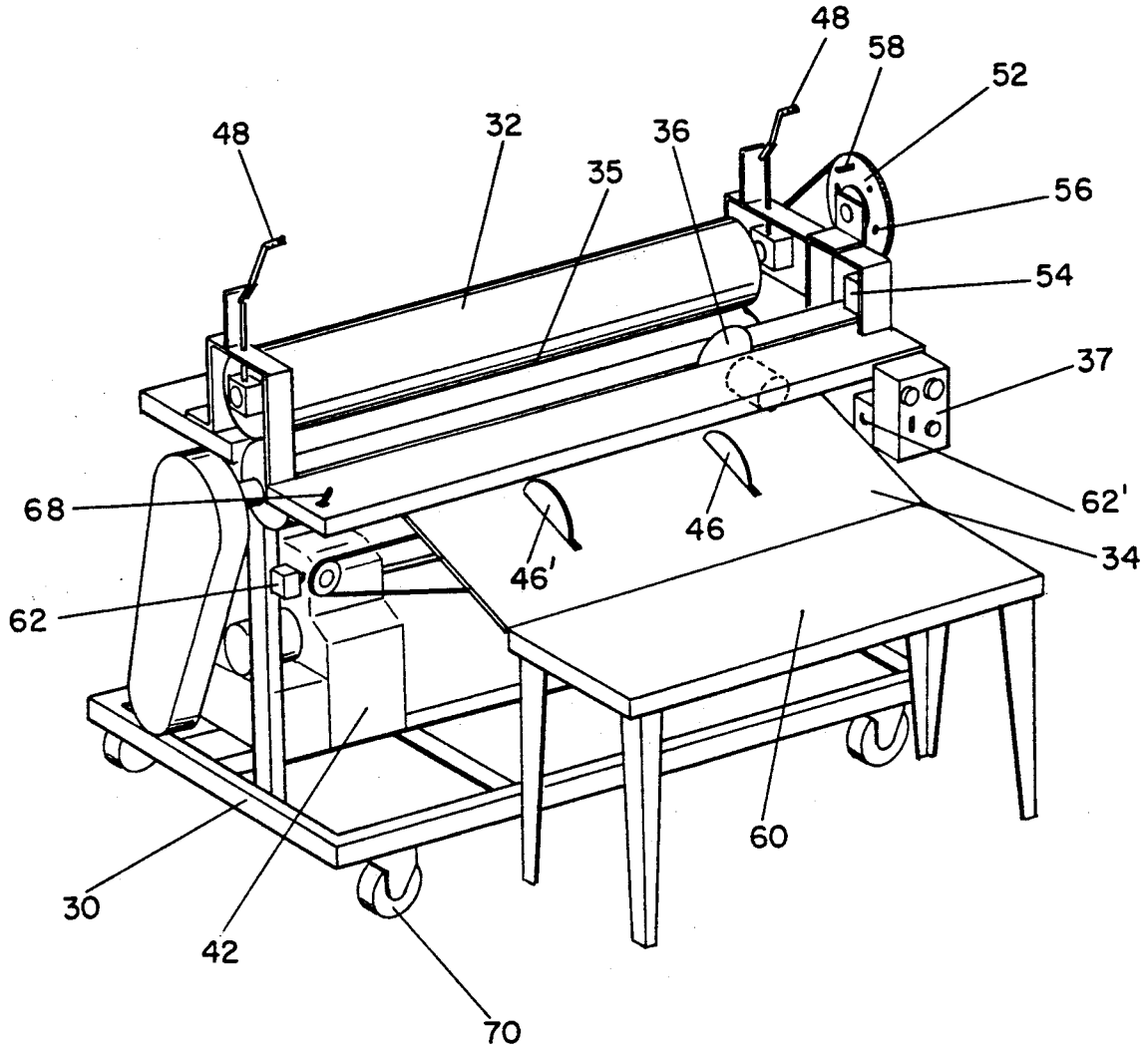
FIG. 3 is a perspective view of the back of the preferred cutting assembly of FIG. 2.

The apparatus of the invention comprises a stacking assembly (FIG. 1) and a cutting assembly (FIGS. 2 and 3). Rolls of paper are stacked and unrolled on the stacking assembly to form a multiplicity of layers of paper which are then cut into predetermined lengths by the cutting assembly. In the preferred embodiment of the invention, the layers of paper can be cut into predetermined widths, as well.

The preferred stacking assembly, as shown in FIG. 1, comprises a main frame 10, an upper rack 12, and a lower rack 14. The main frame 10 supports the two racks 12 and 14. Although FIG. 1 shows two racks 12 and 14, any number of racks may be utilized in accordance with the invention; the stacking assembly of the invention comprises at least one rack. Each rack 12 and 14 comprises a pair of parallel bars 16 (the second bar is not shown due to the side view) which are positioned longitudinally and along opposite sides of the frame 10 and perpendicular to the cutting assembly. Each bar 16 comprises a multiplicity of slots 18. Each slot 18 on one bar 16 of the rack corresponds to a parallel slot on the opposing bar. The slots 18 are spaced along the bar 16 in accordance with the expected diameters of the rolls of paper 24 to be cut. Preferably, the slots 18 are positioned within a few inches of each other so that rolls of paper 24 can be stacked side by side. The openings in the slots 18 preferably face upward to receive a multiplicity of shaft and pin assemblies 20. Each shaft and pin assembly 20 comprises a central shaft and two pins, one positioned at each end of the shaft. The pins are placed in the parallel slots 18 on the rack 12, so that the shaft and pin assembly 20 is positioned between the parallel bar 16. Only one end of the shaft and pin assembly 20 is shown in FIG. 1.

The central shaft of the shaft and pin assembly 20 may be tubular, cylindrical, or square in cross section, or other shapes which can easily fit within a roll of paper 24. End rolls typically have a 3" core diameter. The shaft must have a length which is narrower than the space between the bars 16. End rolls are typically not more than 5' in length. The rack(s) are thus preferably built to accommodate this 5' length. Shorter lengths can also be accommodated because each shaft and pin assembly 20 extends all the way across the rack 14, from bar 16 to bar.

Preferably, the stacking assembly further comprises casters 26 so that the stacking assembly can be easily moved. This is useful to store the apparatus when not in use.

During operation, the central core of a roll of paper 24 is placed on a shaft and pin assembly 20 and placed onto the rack 12. Similarly, a second roll of paper 24' is positioned on the rack 12, preferably near the first roll of paper 24. In this manner, a multiplicity of rolls of paper are preferably positioned side by side on the rack 12. The length of the rack 12 is designed to accommodate as many rolls of paper as desired. For instance, if it is desired to cut 20 to 25 end rolls (typically having a 4" to 6" diameter), a rack length of 10' would be useful. An additional rack 14 or racks can be positioned underneath the upper rack 12 to accommodate even more rolls of paper, such as shown in FIG. 1. The apparatus of the invention is especially useful for cutting end rolls from the newspaper industry. End rolls, having a diameter of only a few inches, as well as end rolls having a diameter of several feet can be stacked and cut in accordance with the invention. (The larger diameter end rolls are often a result of paper tearing; a typical newspaper operation prefers to discard even larger rolls after they have torn.)

Once the rolls of paper 24 are positioned in the racks 12 and 14, the end of the paper on each roll 24 is manually pulled from the roll 24 towards the cutting assembly. The paper is pulled from the top of each roll 24 so that the top of the roll 24 rotates towards the cutting assembly. As the paper is pulled towards the cutting assembly, a multiplicity of layers is formed by the overlapping paper. The ends of the paper from the rolls 24 are preferably joined together before the paper is fed into the cutting assembly. For multiple racks 12 and 14, such as shown in FIG. 1, the paper on the upper rack 12 is pulled directly towards the feeding portion (the rollers 32) of the cutting assembly, whereas the paper on the lower rack 14 is preferably pulled longitudinally along the frame 10 towards the cutting assembly, joined at the ends, and then pulled upwards to join with the paper ends from the upper rack 12, if any. Alternatively, the paper from a roll on the lower rack 14 could be directly pulled upward to join with paper from a roll on the upper rack 12. The multiple layers of paper from both racks 12 and 14 are then fed into the cutting assembly (at the rollers 32) to be cut into sheets with a predetermined length and width.

The cutting assembly shown in FIGS. 2 and 3 comprise a main frame 30 which supports a pair of cylindrical rollers 32, and length cutting means, such as a circular saw 36. The multiplicity of layers of paper from the stacking assembly are fed into and through the rollers 32 and cut into desired lengths by the circular saw 36. Preferably, the rollers 32 can be adjusted by adjusting means 48 so that the space 35 between the rollers 32 can be narrowed or widened. This is useful for accommodating a varying number of layers of paper. The adjusting means 48 can preferably accommodate between 3 to 50 layers of paper.

The cutting assembly also preferably comprises jogging means 68 which can advance the rollers 32 by only a few inches. The jogging means 68 is helpful to initially start the paper through the rollers 32 and to adjust for an initial length.

The cutting assembly further comprises length controlling means to start and stop the rollers 32 such that the sheet lengths can advance and be cut to a predetermined length. The drawing shows a control box 37 which controls a brake 40 to stop the rollers 32 after they have travelled a determined number of rotations which corresponds to the desired length of travel of the paper.

The cutting assembly of the invention preferably further comprises variable length controlling means, such as an index gear 52 and a limit switch 54, shown in FIG. 3, which can vary the number of rotations and thus the length of the paper to be cut. The index gear 52, as shown in FIG. 3, has four possible positions 56 for placing pins or bolts 58 to adjust the length of travel. The bolt 58 contacts the limit switch 54 to stop the rollers 32 after a certain distance of paper travel. These positions shown in FIG. 3 were found to change the paper length from 12" to 36". The cutting assembly of the invention may comprise an index gear with fewer or more positions or may comprise other variable length adjusting means, common to the art.

The cutting assembly of the invention preferably further comprises a variable transmission 42 for varying the speed that the rollers 32 advance. A typical speed for the rollers 32 to advance ranges between inches per second to feet per second, depending upon the application and the degree of automation.

Once the layers of paper are advanced and stopped, the length cutting means, such as the circular saw 36 driven by a blade drive motor 66, cuts all the way across the layers of paper and perpendicular to the direction of paper travel. When this cut is completed, the cut sheets are removed manually or automatically or drop into a pile. FIG. 3 shows a drop table 60 where the cut sheets can accumulate during operation. The pile of cut sheets can then be bundled, if desired. After each cut 14 the rollers 32 then advance more paper, the rollers 32 stop due to the length controlling means, and the circular saw 36 makes another cut.

Preferably, if a circular saw 36 is used for the length cutting means, in accordance with the invention, the saw 36 will travel only once across the width of the cutting assembly for each cut. The saw 36 contacts a starting means, such as a limit switch 62 or 62', one on each side of the cutting assembly, to signal that the cut has been completed and to reactivate the rollers 32 to cause the paper to travel again.

FIG. 2 shows a circular saw 36, as the length cutting means. Other cutting devices, common to the art, such as a slitter, a cutter blade, or a shear blade, can also be used as the length cutting means in accordance with the invention. A circular saw 36 is the preferred length cutting means because it is easier to sharpen and change the blades on a circular saw and to replace the saw. Moreover, a circular saw does not need to return to its starting position after making a cut; it can start a cut from either side of the cutting assembly. A shear blade, on the other hand, which makes a cut by dropping like a guillotine, must be raised and returned to its upward starting position after making the cut.

The preferred cutting assembly of the invention further comprises variable width cutting means, such as cutter blades 46 and 46', shown in FIG. 3, to cut the layers of paper into narrower widths. In this embodiment, the rollers 32 advance the paper onto a cutting surface 34 so that cuts along the path of travel of the paper can be made. A cutting surface 34 is also useful for the cutting assembly of the invention even when only a length cutting means 36 is utilized. Although FIG. 3 shows two cutter blades 46 and 46', one or more width cutting devices may be used in accordance with the invention, depending upon the desired width of the sheets of paper. Preferably, the width cutting means 46 can be adjusted back and forth across the width of the paper or removed entirely so that varying widths can be obtained. The width cutting means 46 can cut the paper before, after, or simultaneously with the length cutting means 36, depending upon the particular cutting devices being utilized.

The cutting assembly, as the stacking assembly, preferably comprises casters 70 so that the apparatus can be easily moved. Portability is useful to store the apparatus while enough end rolls are being accumulated to optimize the use of the apparatus.

During operation of the apparatus of the invention, rolls of paper 24 are placed onto shaft and pin assemblies 20 and placed on the racks 12 and 14. The edges of the rolls of paper are joined together to form a multiplicity of layers which are then fed into the rollers 32. The rollers 32 advance the paper to a predetermined length and then stop. Length cutting means cut across the layers of paper to form cut sheets. If desired, width cutting means 46 cut the paper or the sheets into predetermined widths. The cut sheets are then removed or drop away from the apparatus.

Although the invention has been described with reference to these preferred embodiments, other embodiments can achieve the same results. Variations and modifications of the present invention will be obvious to those skilled in the art and it is intended to cover in the appended claims all such modifications and equivalents.

I claim:

1. An apparatus for stacking, unrolling and cutting a large plurality of rolls of paper, said apparatus comprising: a multiple tiered paper roll stacking frame comprising at least two tiers of parallel, longitudinal bars each comprising a large plurality of pairs of slots oppositely positioned on said bars for receiving and rotatably holding pins extending from shafts disposed within the centers of a large number of rolls of paper to be cut;

a pair of parallel cylindrical drive rollers disposed on said cutting frame and positioned to receive paper from the large number of rolls of paper as fed from said stacking frame, said rollers being spacedly adjustable to accommodate continuous stacks of paper having different thicknesses, thereby providing means for adjusting the amount of force applied by said rollers on the continuous stacks to facilitate moving a continuous stack of a large number of sheets of paper without slippage among the sheets thereof;

jogging means for rotating said rollers to facilitate lengthwise alignment of the large number of sheets within a continuous stack of paper preparatory to moving the continuous stack through said rollers for cutting;

means for simultaneously drivably rotating each of said rollers a predetermined amount to move the continuous stack of paper a preselected distance; and means for cutting the continuous stack of paper to a predetermined length in accordance with said preselected distance of movement through said drive rollers.

2. The invention of claim 1 further comprising means for lengthwise cutting a continuous stack of paper as it is moved through said apparatus by said drive rollers.

3. The invention of claim 1 further comprising means for adjustably controlling the speed of said drive rollers.

4. The invention of claim 1 wherein said paper length cutting means comprises a bi-directionally cutting circular saw.

* * * * *